US011015775B2

(12) United States Patent
Weyhaeghe et al.

(10) Patent No.: US 11,015,775 B2
(45) Date of Patent: May 25, 2021

(54) CONFIGURABLE AND ADJUSTABLE LUMINAIRE VIA GUIDE ARMS AND GUIDE SLOTS

(71) Applicant: SIGNIFY HOLDING B.V., Eindhoven (NL)

(72) Inventors: Lukas Weyhaeghe, Eindhoven (NL); Florent Aubert, Aachen (DE); Jeffrey Huyghe, Heule (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/483,455

(22) PCT Filed: Jan. 31, 2018

(86) PCT No.: PCT/EP2018/052327
§ 371 (c)(1),
(2) Date: Aug. 5, 2019

(87) PCT Pub. No.: WO2018/141760
PCT Pub. Date: Aug. 9, 2018

(65) Prior Publication Data

US 2020/0018452 A1 Jan. 16, 2020

(30) Foreign Application Priority Data

Feb. 6, 2017 (EP) ..... 17154850

(51) Int. Cl.
*F21S 8/02* (2006.01)
*F21V 21/04* (2006.01)
(Continued)

(52) U.S. Cl.
CPC ..... *F21S 8/026* (2013.01); *F21V 14/02* (2013.01); *F21V 21/04* (2013.01); *F21V 21/047* (2013.01); *F21V 21/14* (2013.01); *F21V 29/70* (2015.01)

(58) Field of Classification Search
CPC ..... F21S 8/026; F21S 8/028; F21V 21/047; F21V 21/14; F21V 14/02
(Continued)

(56) References Cited

U.S. PATENT DOCUMENTS 6,655,813 B1 12/2003 Ng
8,342,721 B2 1/2013 Park et al.
(Continued)

FOREIGN PATENT DOCUMENTS

CN 204 301 005 U 4/2015
DE 3447606 A1 7/1986
(Continued)

OTHER PUBLICATIONS

Hierzer, A lighting device, Dec. 2016, Espacenet Patent Translate https://worldwide.espacenet.com/ (Year: 2016).*

*Primary Examiner* — Rajarshi Chakraborty
*Assistant Examiner* — Michael Chiang
(74) *Attorney, Agent, or Firm* — Daniel J. Piotrowski

(57) ABSTRACT

The invention provides a luminaire comprising an outer housing and an inner housing slidable within the outer housing. The inner housing carries a lighting unit. The inner housing slides within the outer housing between at least one latched positions at different recess depths and it is also removable from the outer housing to enable replacement of the lighting unit, all without needing tools.

13 Claims, 9 Drawing Sheets

(51) Int. Cl.
*F21V 21/14* (2006.01)
*F21V 14/02* (2006.01)
*F21V 29/70* (2015.01)

(58) Field of Classification Search
USPC ..... 248/249
See application file for complete search history.

(56) References Cited

U.S. PATENT DOCUMENTS

2005/0018434 A1 1/2005 Giuliano
2009/0321598 A1* 12/2009 Vann ..... F21V 21/30 248/227.1
2012/0236580 A1* 9/2012 Cheng ..... F21V 29/00 362/387
2015/0070897 A1 3/2015 Chien
2015/0233558 A1* 8/2015 Ticktin ..... F21V 21/22 362/404
2015/0345761 A1* 12/2015 Lawlor ..... F21V 21/14 362/364
2016/0131317 A1* 5/2016 Doyon ..... F21S 8/028 362/365
2016/0201884 A1* 7/2016 Ramirez ..... F21V 23/006 362/147
2017/0067617 A1* 3/2017 Luo ..... F21V 7/16
2019/0285259 A1* 9/2019 Tickner ..... F21V 23/06

FOREIGN PATENT DOCUMENTS

DE 102015211102 B3 * 12/2016 ..... F21V 21/14
DE 102015211102 B3 12/2016
EP 3104073 A1 12/2016
GB 2517222 A 2/2015
GB 2538244 A 11/2016
WO 2014154611 A1 10/2014

* cited by examiner

CONFIGURABLE AND ADJUSTABLE LUMINAIRE VIA GUIDE ARMS AND GUIDE SLOTS

CROSS-REFERENCE TO PRIOR APPLICATIONS

This application is the U.S. National Phase application under 35 U.S.C. § 371 of International Application No. PCT/EP2018/052327, filed on Jan. 31, 2018, which claims the benefit of European Patent Application No. 17154850.6, filed on Feb. 6, 2017. These applications are hereby incorporated by reference herein.

FIELD OF THE INVENTION

This invention relates to a luminaire, in particular with an adjustable position of a lighting unit.

BACKGROUND OF THE INVENTION

Recessed luminaires are used to create flush lighting units in a sheet or concrete structure, such as a ceiling. Typically, there is an outer housing which is fixed to the ceiling and an inner part which carries a light engine (for example comprising a light source, an optical element such as a lens and/or reflector, and a heat sink), or else the inner part is just a light engine, which is removable from the outer part to enable replacement of the light engine.

There is a desire to make the changing of the light engine as easy as possible, without needing tools or special skills.

There is also a desire to be able to alter the lighting characteristics of the luminaire in a simple and intuitive way. One way to create different lighting characteristics is to define how far the light engine is recessed into the housing. For example, with a deeply recessed light engine, the side walls of the recess may perform a beam shaping or collimation function to provide more directed light output and lower glare, whereas with a shallowly recessed light engine wider angle lighting may be provided. Different light engine positions also give different aesthetic appearances, and different users may have different preferences.

There remains a need for a luminaire design which can achieve all of these functions.

SUMMARY OF THE INVENTION

The invention is defined by the claims.

According to examples in accordance with an aspect of the invention, there is provided a luminaire comprising:

an outer housing;

a clamping arrangement for clamping the outer housing to a sheet or concrete article with the outer housing extending through an opening in the sheet or concrete article;

an inner housing, which is slidable within the outer housing; and a lighting unit carried by the inner housing, wherein the inner housing is insertable into and removable from the outer housing, wherein the inner housing is adapted to be:

slidable within the outer housing to a first latched position after insertion;

slidable from the first latched position to a second latched position, in which the second latched position has the inner housing recessed within the outer housing; and removable from the outer housing by sliding from the second latched position to a release position.

This luminaire thus has an adjustable position of the inner housing, and hence an adjustable position of the lighting unit relative to the outer housing. The inner housing can also be removed from the outer housing by a further sliding action, so that simple replacement of the lighting unit is possible.

The outer housing may comprise a single piece or it may comprise multiple pieces that cooperate to form a single outer housing assembly. These multiple pieces may, for example, comprise a first frame having a flange which provides an aesthetic appearance, similar to a so-called trim ring; at least one resilient member to provide fixation to the sheet or concrete material (which functions as the clamping arrangement); and a second frame. The second frame has features to provide the latching function with the inner housing, such as at least one guide slot and/or at least one sprung finger.

The luminaire for example comprises a recessed or flush ceiling or wall luminaire.

In the first latched position, an outer face of the inner housing may be flush with or protruding from an outer face of the outer housing. This provides a flush or projecting overall appearance and for example provides a wide beam general lighting effect. The second latched position is recessed and for example provides a more directional lighting effect and less glare for higher lighting comfort.

The two latched positions may instead have different levels of recessing. There may be more than two latched positions.

The sliding to the first latched position, the sliding to the second latched position and the sliding to the release position are all adapted to be performed by pushing the inner housing. This means that no tools are required. Also it means that the adjustments do not risk pulling the outer housing away from the ceiling or wall. Instead, the inner housing is inserted into the outer housing, and pushing (e.g. upwardly) on the inner housing then sets in sequence the first latched position, the second latched position and the release position. In the release position, the inner housing can drop out, for example with the aid of gravity.

The luminaire is for example adapted to provide an audible sound associated with the first and second latched positions. This makes it easy to tell when the position adjustment has been made.

In one example, one of the inner and outer housings comprises at least one sprung guide finger and the other of the of the inner and outer housings comprises at least one guide slot, and the guide slot comprises a first catch portion for the guide finger for setting the first latched position and a second catch portion for the guide finger for setting the second latched position. The catch portions for example comprise notches or recesses which trap the end of the guide finger.

In one preferred embodiment, the outer housing comprises the at least one sprung guide finger and the inner housing comprises the at least one guide slot.

In this design, the latch positions are set by engagement of a finger in a slot. The bias of the finger makes the finger follow a track when the inner housing is slid within the outer housing, and this track has the catch portions. The catch portions are for example for holding the extreme remote end of the guide finger. However, the shape of the end of the guide finger is such that further pushing of the inner housing releases the guide finger from its catch. The end of the guide finger is for example rounded.

The guide slot for example comprises an end portion for setting the released position. The guide slot for example comprises a U-shaped channel wherein one channel arm defines the first and second latched position and the guide finger is insertable into the one channel arm, the U-bend at the end forms the end portion, and other channel arm forms a removal path. The removal path may be positioned such that it corresponds to a relaxed position of the sprung guide finger. This means the guide finger moves freely along the removal path, and this may be under gravity.

The removal path may comprise a third catch portion for preventing the inner housing falling out of the outer housing. Thus, the inner housing can drop under gravity, but the inner housing will not fall out. It may need a final pull to get past the third catch portion. Part of the inner housing protrudes from the outer housing at this position, so that the inner housing can easily be gripped from the outside.

The inner housing for example comprises the guide slot and the outer housing comprises the guide finger.

There is preferably a plurality of guide finger and guide slot pairs for example four guide finger and guide slot pairs.

The lighting unit may comprise a single light source or an array of light sources. The array of light sources may be carried by a single inner housing, and hence be moved as one unit. Alternatively, there may be a plurality of inner housings slidable within a shared outer housing, so that each inner housing is independently adjustable.

Examples in accordance with another aspect of the invention provide a method of installing a luminaire, comprising:

clamping an outer housing to a sheet or concrete article with the outer housing extending through or flush with an opening in the sheet or concrete article;

inserting an inner housing which carries a lighting unit into the outer housing;

sliding the inner housing within the outer housing to a first latched position to define a first lighting unit position;

subsequently sliding the inner housing from the first latched position to a second latched position, in which the second latched position has the inner housing recessed within the outer housing, to define a second lighting unit position; and subsequently removing the inner housing from the outer housing by sliding from the second latched position to a release position, wherein the sliding to the first latched position, the sliding to the second latched position and the sliding to the release position are all performed by pushing the inner housing.

BRIEF DESCRIPTION OF THE DRAWINGS

Examples of the invention will now be described in detail with reference to the accompanying drawings, in which.

DETAILED DESCRIPTION OF THE EMBODIMENTS

The invention provides a luminaire comprising an outer housing and an inner housing slidable within the outer housing. The inner housing carries a lighting unit. The inner housing slides within the outer housing between at least two latched positions at different recess depths and it is also removable from the outer housing to enable replacement of the lighting unit, all without needing tools.

Figure 1:
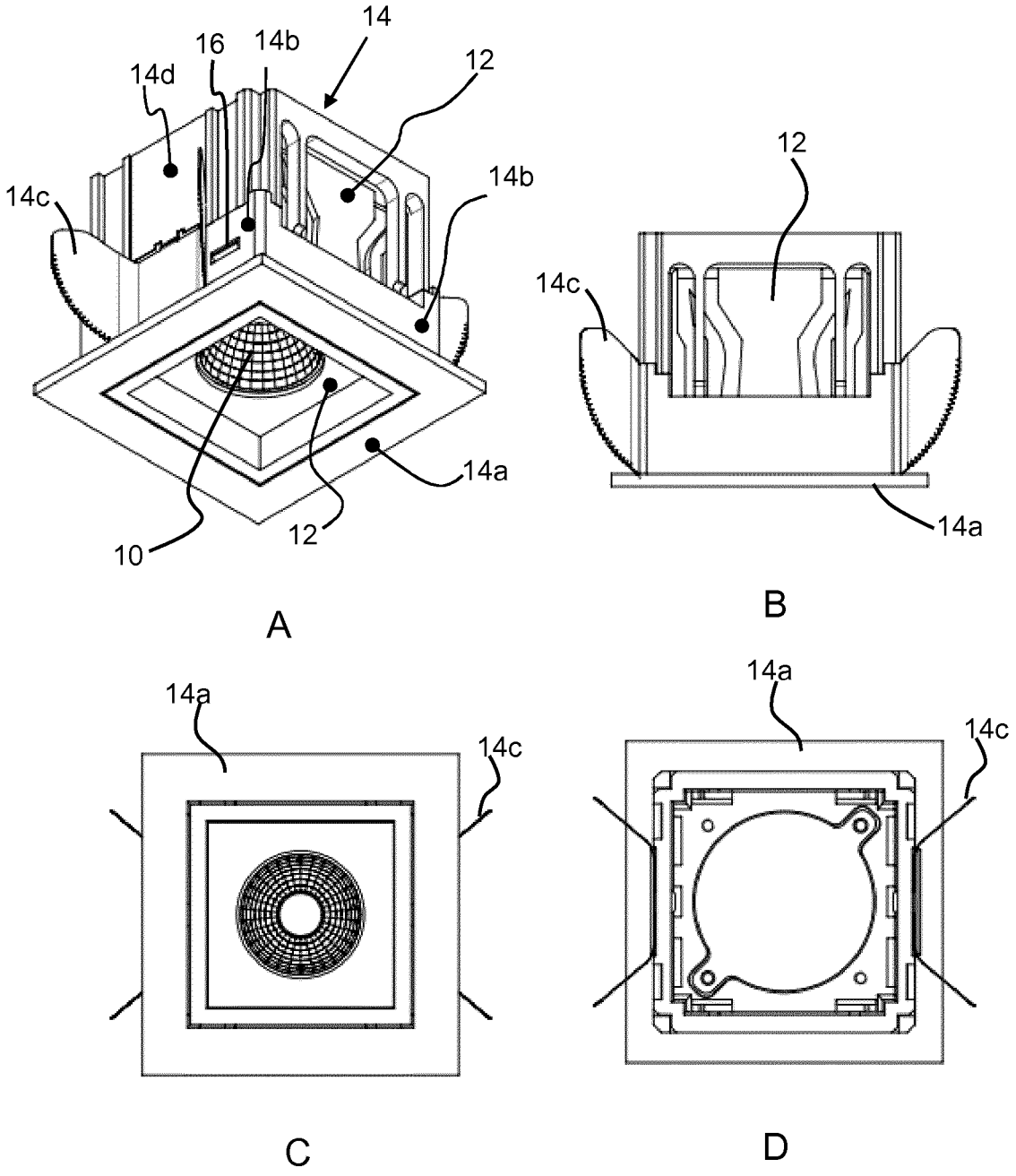
FIG. 1A shows a first example of a luminaire having a single lighting element in a first latched position, shown in a prospective view.
FIG. 1B shows a side view of the first example of the luminaire.
FIG. 1C shows a view from beneath (facing the light output face) of the first example of the luminaire.
FIG. 1D shows a view from above of the first luminaire.

FIG. 1 shows a first example of a luminaire having a single lighting element, in particular a light engine 10, carried by an inner housing 12. The term light engine in this case may for example relate to a set of assembled components such as one or more light sources (incandescent or fluorescent bulb, LED, OLED), an optical element (lens, reflector) and a heat sink. The general term "lighting unit" is intended to cover any type of light source, with or without optical elements and with or without a heat sink.

The inner housing 12 is slidable within an outer housing 14. FIG. 1A is a perspective view, FIG. 1B is a side view, FIG. 1C is a view from beneath (facing the light output face) and FIG. 1D is a view from above.

The outer housing 14 is clamped to a sheet or concrete article (not shown) with the outer housing extending through an opening in the sheet or concrete. The opening can be made into plasterboard, wooden, metallic or concrete material or a combination of these, for ceiling and wall applications.

The outer housing has a rim 14*a* which sits against the ceiling and is thus slightly larger than the hole provided in the ceiling. As an alternative, the outer housing does not have a rim, whereby the outer housing is flush with the ceiling.

Extending from the rim 14*a* is a surround 14*b* which has an outer shape designed to match the opening in which the luminaire is to be fitted.

A clamping part 14*c* fixes the outer housing to the ceiling (or wall). In the example shown, the clamping part 14*c* comprises a set of resilient members which press against the material around the surround 14*b*. The clamping part 14*c* may be considered to be part of the outer housing (since it forms part of an assembled outer housing unit) or it may be considered to be a separate part for fixing the (other parts of the) outer housing to the wall or ceiling.

The resilient members comprise webs which are biased outwardly (i.e. away from the surround 14*b*) into the open position shown in FIG. 1. They can be pushed flat against the surround 14*b* of the outer housing into a closed position so that the outer profile becomes a square (or rectangle) which can fit in a suitable opening, and when released, they open again.

The outer housing also has a carriage part 14*d* which defines an open channel for receiving the inner housing 12.

There are three parts in this example of the design of the outer housing. The rim 14*a* and the surround 14*b* are one solid part for example of aluminum (or plastic). The resilient members 14*c* are a separate part which can be attached to the surround for example by sliding up/down into a receiving slot, or they may have hooks at their upper surface which hook over a top edge of the surround 14*b*. The resilient members are for example formed by a sprung metal sheet such as a stainless steel spring sheet (one of which forms a pair of resilient members and a joining web between them). The third part is the carriage 14*d* which is for example a plastic part to provide the desired flexible biased fingers.

To install the overall outer housing, the resilient members 14*c* are installed on the surround 14*b* for example by hooking them over the top. The carriage part 14*d* is attached to the surround 14*b*, and this may be by means of clips 16.

This creates a fully assembled outer housing unit. This assembly may be carried out by the manufacturer or by the user. If carried out by the manufacturer, the user simply has to push the fully assembled unit into a suitable opening.

The fully assembled unit can then be inserted through a hole or into a recess in the ceiling or wall. The resilient members 14*c* are pressed flat against the surround 14*b* to enable the assembled unit to fit into a suitably sized opening. When pushing the unit into the opening, the resilient members remain attached to the surround even if they are only loosely hooked over the surround 14*b*, because the insertion direction serves to keep them attached (i.e. the wall or ceiling pushes down on the resilient members).

Once in place, the resilient members are held back by the wall or ceiling material and they provide a lateral gripping force. They may also partially bite into soft material such as plasterboard.

In this way, the outer housing is firmly attached to the ceiling, and this can all be carried out from below the ceiling.

The rim 14*a* provides an aesthetic appearance and masks the edges of the hole cut into the sheet material. In this example, two pairs of resilient members 14*c* are used, and they are advantageously located on opposite sides of the first frame outer housing.

Any other clamping arrangement may be used to hold the outer housing in place, including radially expanding springs which clamp against the top surface of the ceiling sheet or concrete. The resilient members may instead be formed integrally with the rim 14*a* and surround 14*b*. The complete outer housing 14 may in another design be a single component. Thus, the three-piece design shown is simply an example.

The inner housing 12 is slidable within the outer housing 14, and it is slidable between at least two latched positions.

FIG. 1 shows a first latched position in which the outer face of the inner housing 12 is flush with the rim 14*a*.

Figure 2:
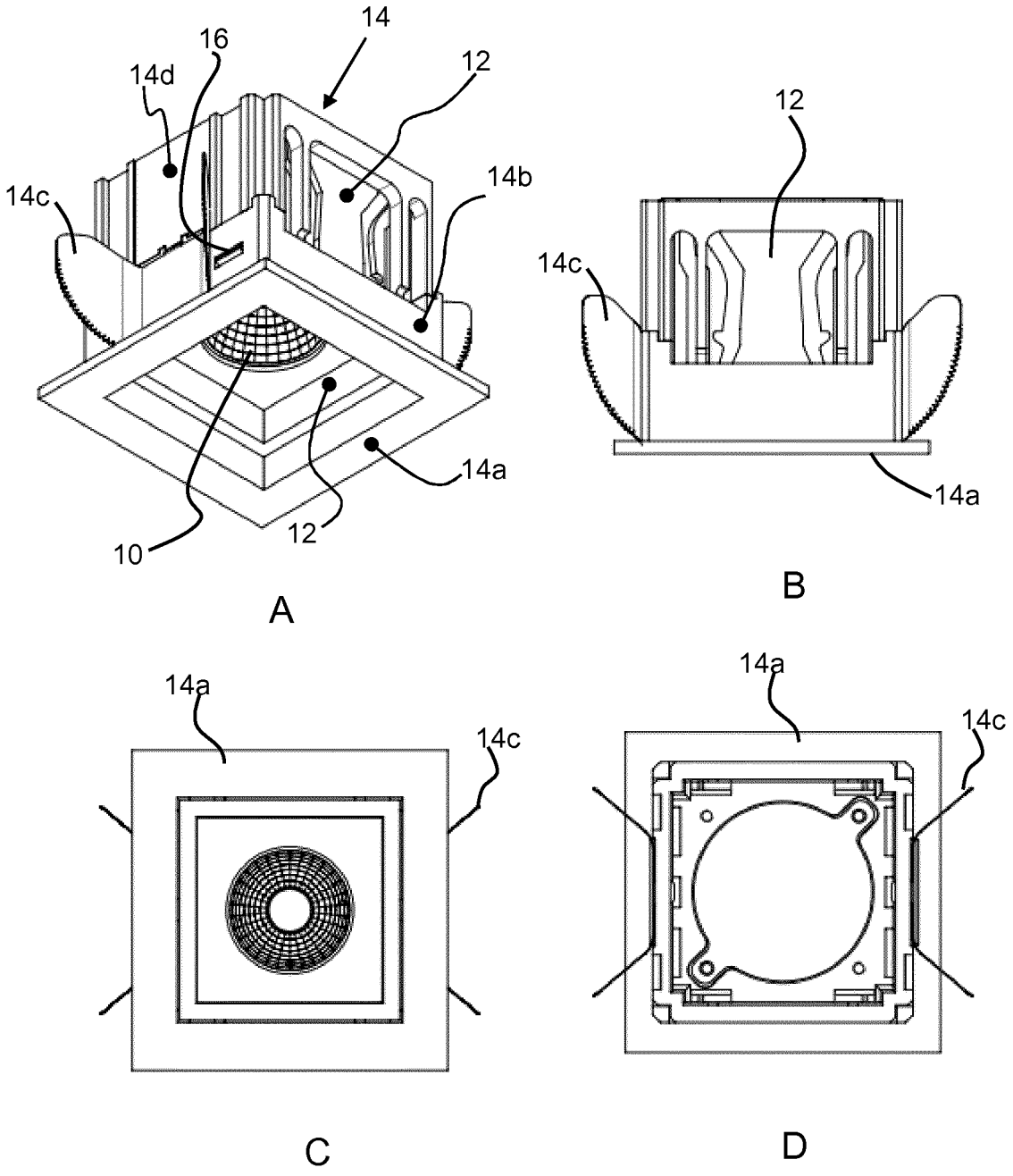
FIG. 2A shows the luminaire of FIG. 1 in a second latched position, shown in a prospective view.
FIG. 2B shows a side view of the first example of the luminaire in a second latched position.
FIG. 2C shows a view from beneath (facing the light output face) of the first example of the luminaire in a second latching position.
FIG. 2D shows a view from above of the first luminaire in a second latching position.

FIG. 2 shows a second latched position in which the outer face of the inner housing 12 is recessed back from the rim 14*a*. To adjust from the first latched position to the second latched position, the inner housing is simply pushed inwardly (i.e. upwardly in the case of a ceiling installation). Furthermore, by pushing the inner housing up even further, the inner housing moves to a release position which enables it to be removed to replace or service the light engine. By enabling the inner housing to fall at least partly under gravity, the need for tools to remove the inner housing is also avoided as will be explained further below.

The outer housing is fitted to the ceiling simply by holding back the resilient members and pushing the unit into the opening.

To fit a light engine into the assembled and mounted outer housing, the electrical connection to the light engine is made (with the connection wire hanging down through the hole in the ceiling, and through the outer housing), then the light engine is fitted to the inner housing. The inner housing is then simply pushed into the outer housing.

This luminaire thus has an adjustable position of the inner housing, and hence an adjustable position of the light engine (which is fixed in position relative to the inner housing) relative to the outer housing (which is fixed in position relative to the ceiling).

The first latched position of FIG. 1 provides a more flush overall appearance and for example provides a wide beam general lighting effect. The second latched position of FIG. 2 is recessed and for example provides a more directional lighting effect and less glare.

The luminaire provides an audible sound associated with the first and second latched positions. This makes it easy to tell when the position adjustment has been made.

Figure 3:
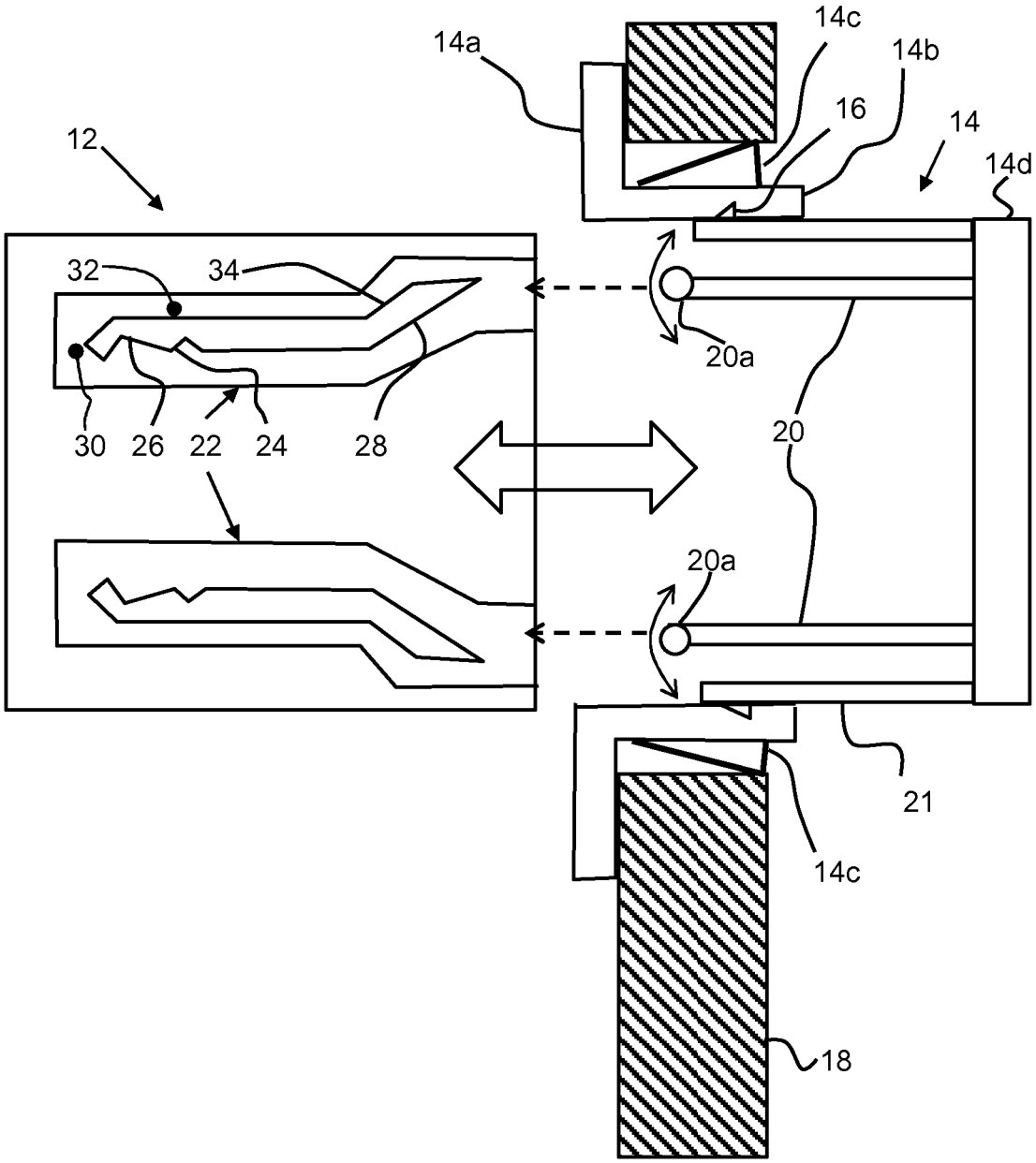
FIG. 3 shows an example of one possible arrangement for implementing the latching function.

FIG. 3 shows an example of one possible arrangement for implementing the latching and release function described above. It shows the outer housing 14 clamped to a ceiling plasterboard sheet or concrete ceiling 18.

The outer housing 14 has a set of sprung guide fingers 20. There is at least one such guide finger, but preferably a set of fingers around the shape of the outer housing. Two guide fingers are shown in FIG. 3 on one side of the outer housing. There is a corresponding pair of guide fingers on the opposite side.

The inner housing 12 has a corresponding set of guide slots 22. Each guide slot 22 forms a U-shaped channel for guiding the end 20*a* of the corresponding guide finger.

There are be further guides to keep the inner and outer housings parallel and together during installation and adjustment.

For example, alignment pins 21 form part of the carriage 14*d*, for example near the corners of the outer housing, and they slide in corresponding straight channels in the outer walls of the inner housing 12. These alignment pins 21 include clips which form part of the latch 16, by clipping into openings in the surround 14*b*.

When the inner housing is inserted into the outer housing, the guide finger naturally enters a first channel arm of the U-shaped channel. This arm has a first catch portion 24 for the guide finger for setting the first latched position and a second catch portion 26 for the guide finger for setting the second latched position.

In this way, the latch positions are set by engagement of a finger in a slot.

When the inner housing is inserted into the outer housing, the finger is deformed from its rest position by a ramp 28. This means the end of the finger is biased into the catch portions 24, 26, which each comprise a recess or notch in which the end of the finger can sit. However, the shape of the end 20*a* of the guide finger 20 is rounded so that pushing of the inner housing can relatively easily release the guide finger from its catch so that the guide finger can travel further along the guide 22 slot. There is a clicking sound when the guide finger snaps into a catch 24,26.

The guide slot has an end portion 30 (the U-bend) for setting the released position. The second channel arm forms a removal path 32. The removal path corresponds in position to a relaxed position of the sprung guide finger 20. This means the guide finger moves freely along the removal path 32 without pressing to the sides, and this may be under gravity.

Thus, it can be seen that the insertion of the inner housing, the advance to the first catch position, the advance to the second catch position and the advance to the release position are all achieved simply by pushing.

Once in the release position, the spring bias places the end of the guide arm at the end of the removal path 32. Gravity then partially drops the inner housing out (i.e. to the left in FIG. 3), but the removal path 32 has a third catch portion 34 for preventing the inner housing 12 falling out of the outer housing 14. The inner housing 12 has to be pulled out to get past the third catch portion 34, which is in the form of a ramp. However, part of the inner housing is then protruding beyond the outer housing so that there is an easy body to grip by hand.

The guide slot and the guide finger may be arranged the other way around, with slots in the outer housing and fingers on the inner housing.

There may be more catch portions along the channel to define additional stopping points.

The design of the guide slots and guide fingers dictates the amount of force needed, the different positions and the audible sound. The surround 14*b* (FIGS. 1 and 2) provides a blocking function to prevent the guide fingers slipping out (radially outwardly) from their guide slots.

There are various possibilities for the design of the inner housing, to provide a beam shaping function.

FIGS. 4 to 9 show various examples, in the two different recess positions.

Figure 4:
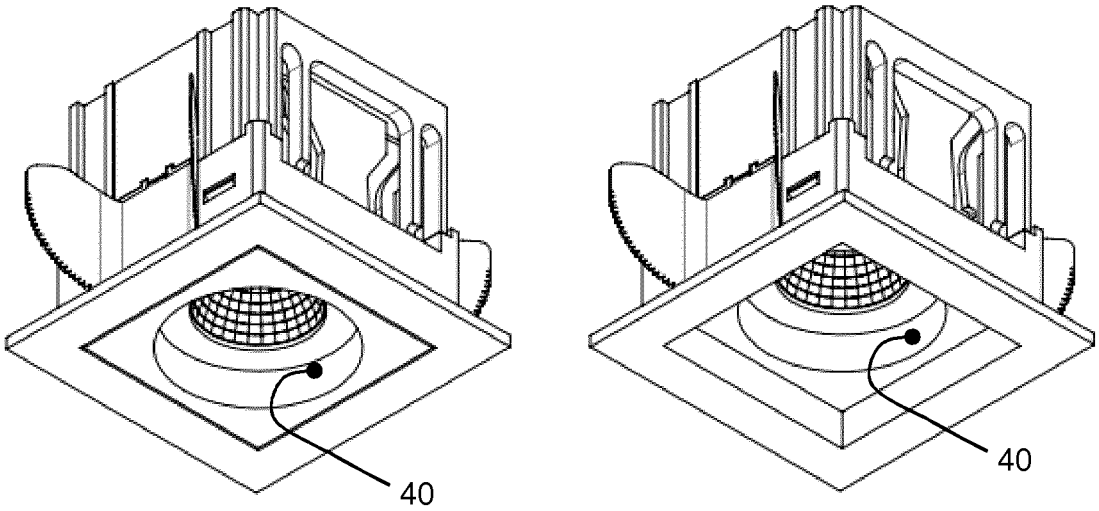
FIGS. 4 to 9 show various examples of luminaire, each with a single lighting element, in two different recess positions.

FIG. 4 shows that the inner housing holds the light engine at the base of a circular recess 40.

Figure 5:
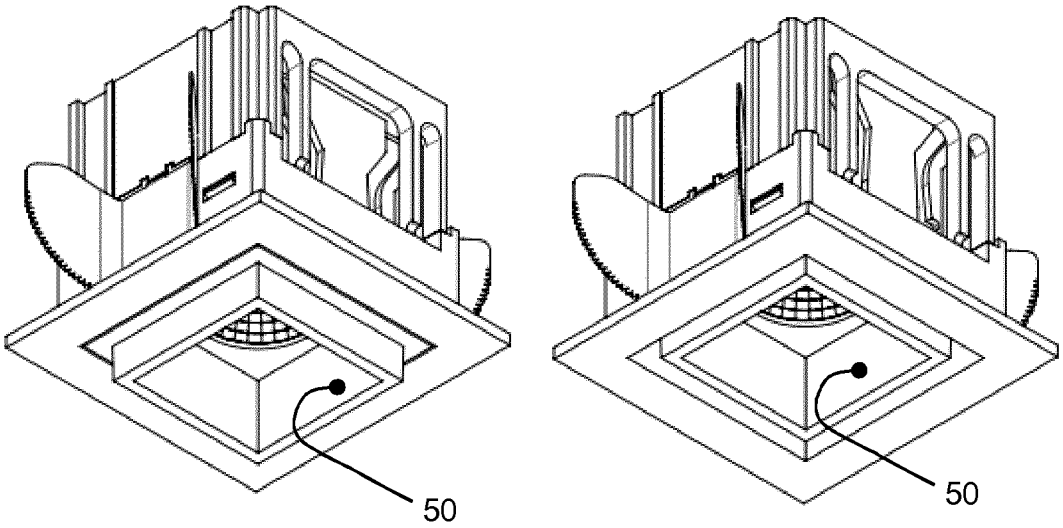

FIG. 5 shows that the inner housing has a square shroud 50 around the light engine.

Figure 6:
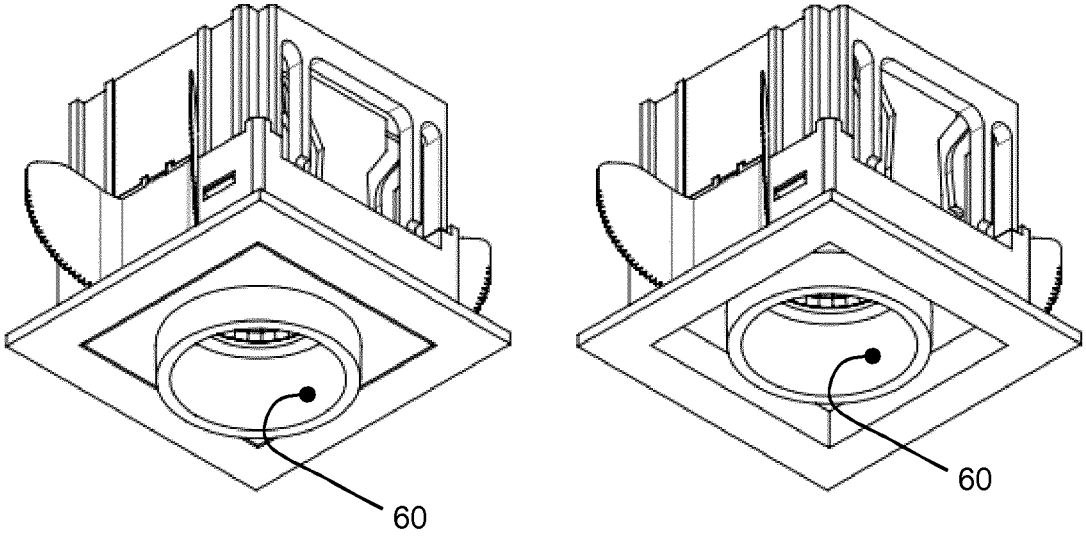

FIG. 6 shows that the inner housing has a circular shroud 60 around the light engine.

Figure 7:
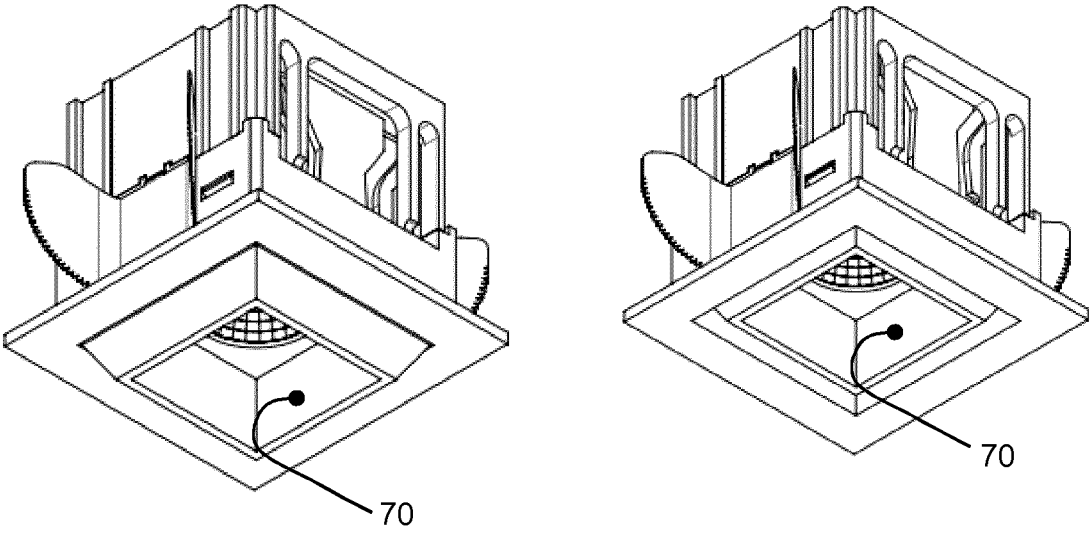

FIG. 7 shows that the inner housing has a square inwardly tapered shroud 70 around the light engine.

Figure 8:
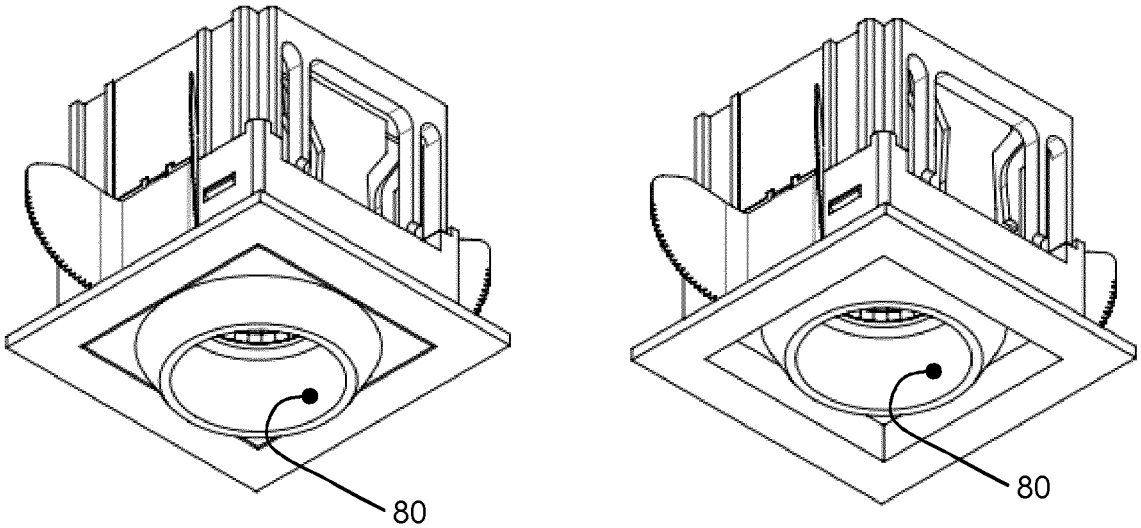

FIG. 8 shows that the inner housing has a circular inwardly tapered shroud 80 around the light engine.

Figure 9:
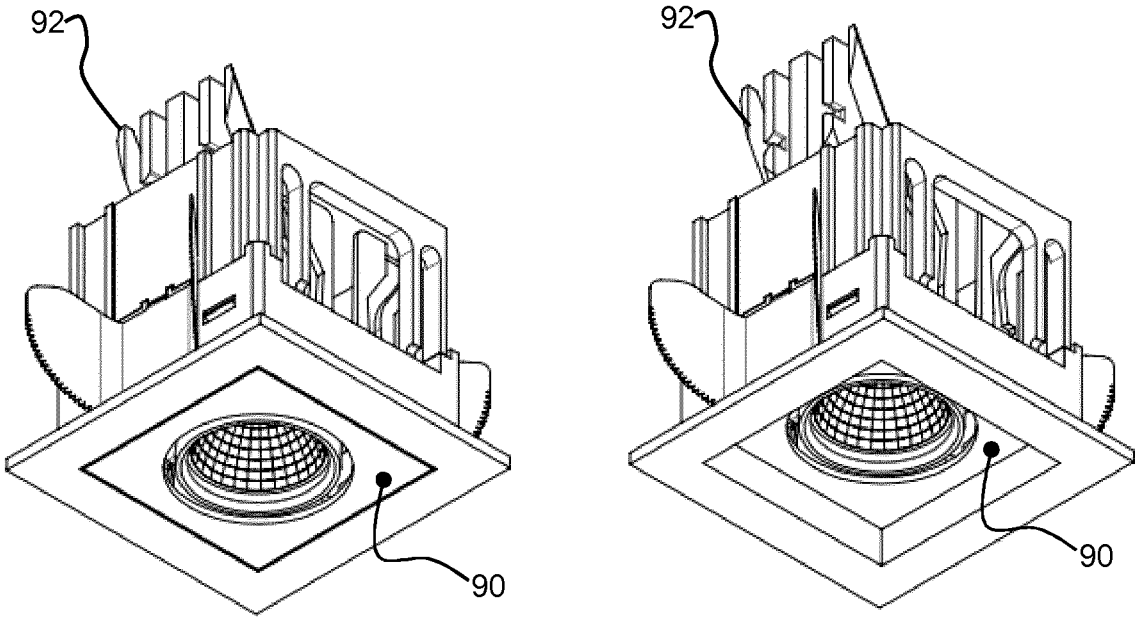

FIG. 9 shows that the inner housing has a flat outer surface with the light engine surface flush with that outer surface. It also shows that the inner housing may be provided with heat dissipation fins 92.

The purpose of providing a recessed position of the light engine may be purely for the aesthetic appearance (even when the light engine is turned off) or it may be for creating a different lighting effect. Generally, by bringing the light engine into a more recessed position, a different light experience is created: the light comfort will be improved as the luminaire will become less glary. The movement of the light engine may also alter the light output in combination with some optical systems (reflectors or lenses), and further reduce a blinding effect.

Figure 14:
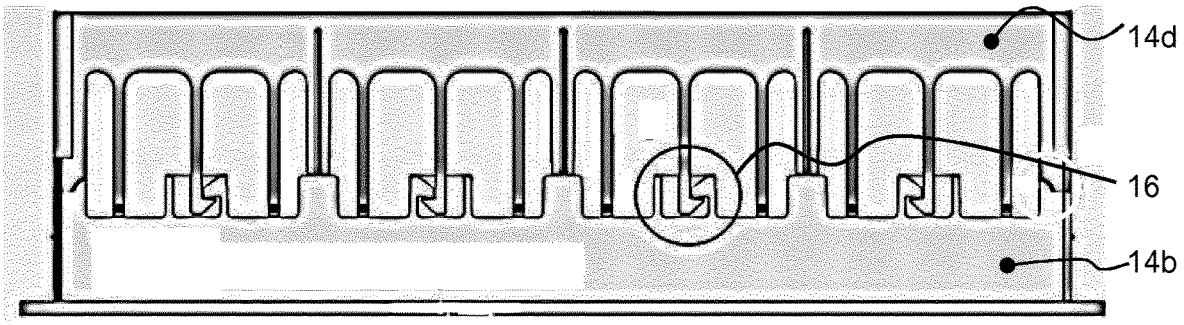
FIG. 14 shows an alternative coupling between different parts of the outer housing.

The example above shows a clip 16 for attaching the carriage 14*d* to the surround 14*b* which deforms radially inwardly when assembled and then clicks outwardly. FIG. 14 shows an alternative design for the clips 16 in which they deform within the plane of the carriage 14*d* rather than out of plane. This makes the attachment more robust to warpage.

In the examples above, the lighting unit comprises a single light engine. Each light engine include a set of light sources all within a single inner housing.

There may however also be a plurality of inner housings slidable within a shared outer housing, so that each inner housing is independently adjustable.

Figure 10:
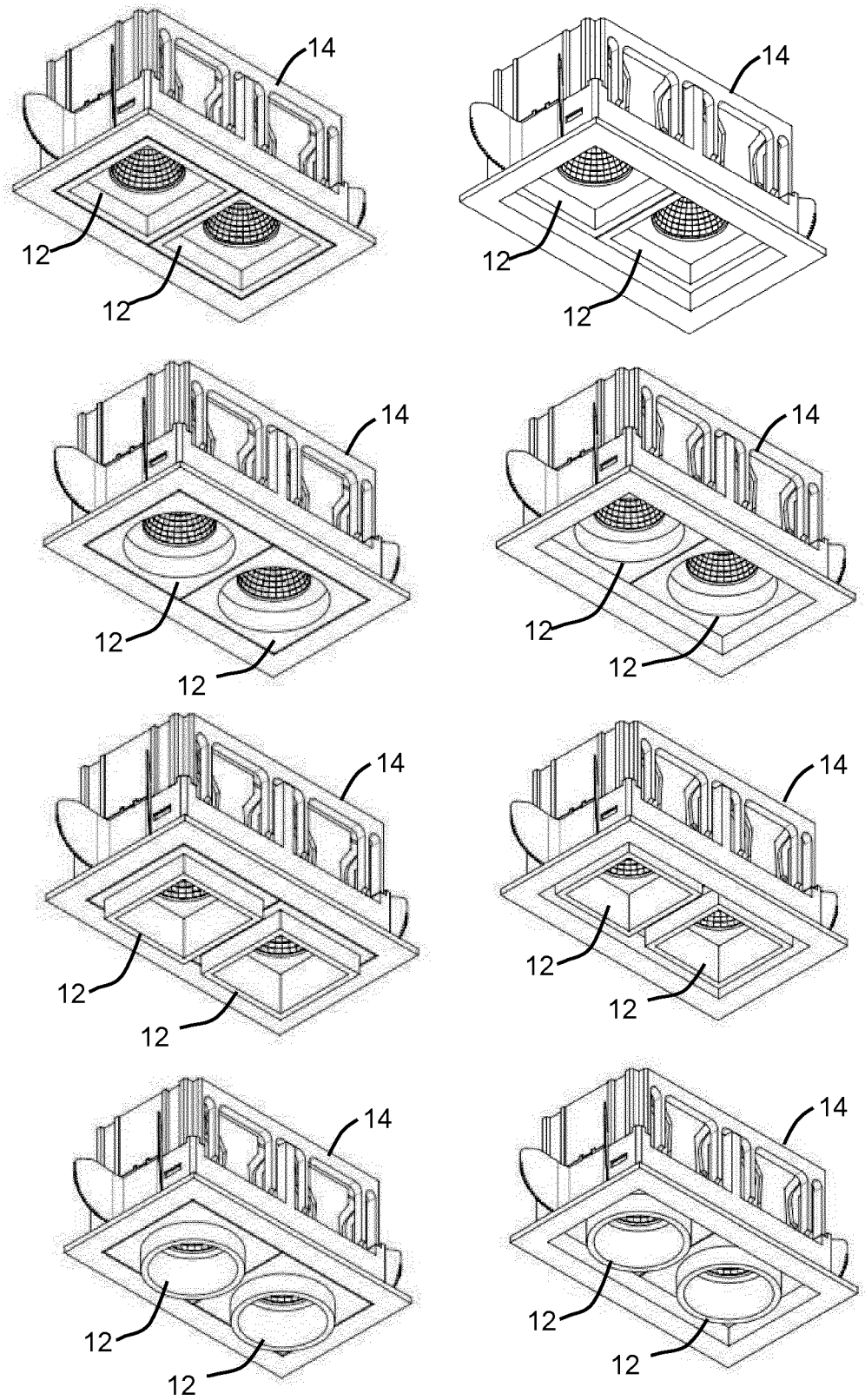
FIGS. 10 and 11 show various examples of luminaire in which the outer housing receives two inner housings.
Figure 11:
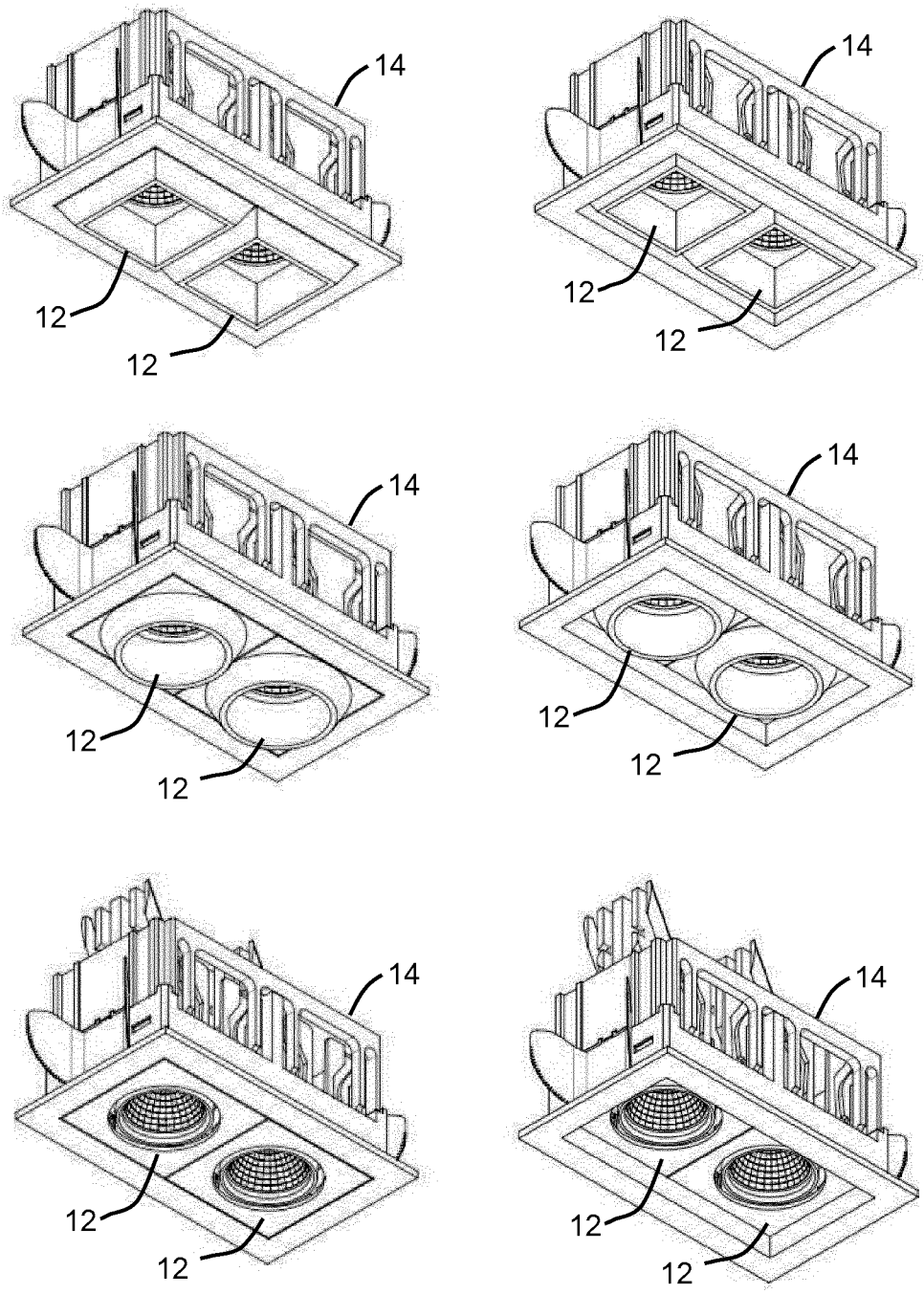

FIGS. 10 and 11 show various examples based on some of FIGS. 1 to 9, but with the outer housing 14 receiving two inner housings 12. The various arrangements are shown in the two different recess positions.

Figure 12:
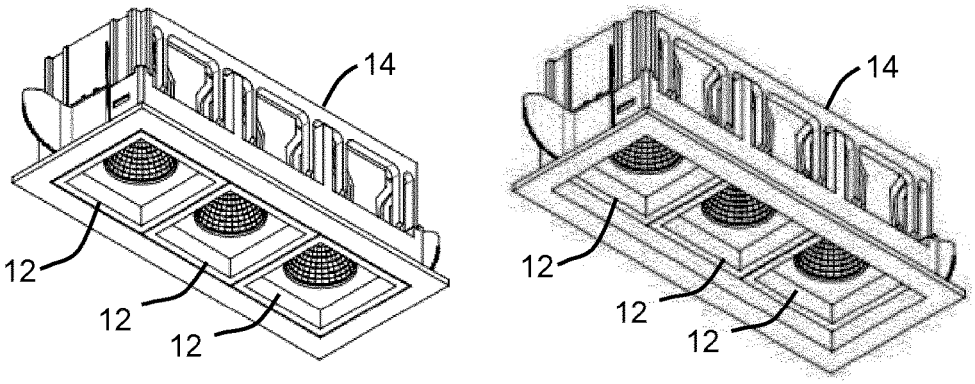
FIG. 12 shows an example of a luminaire in which the outer housing receives three inner housings.

FIG. 12 shows one example based on FIGS. 1 and 2, but with the outer housing 14 receiving three inner housings 12.

Figure 13:
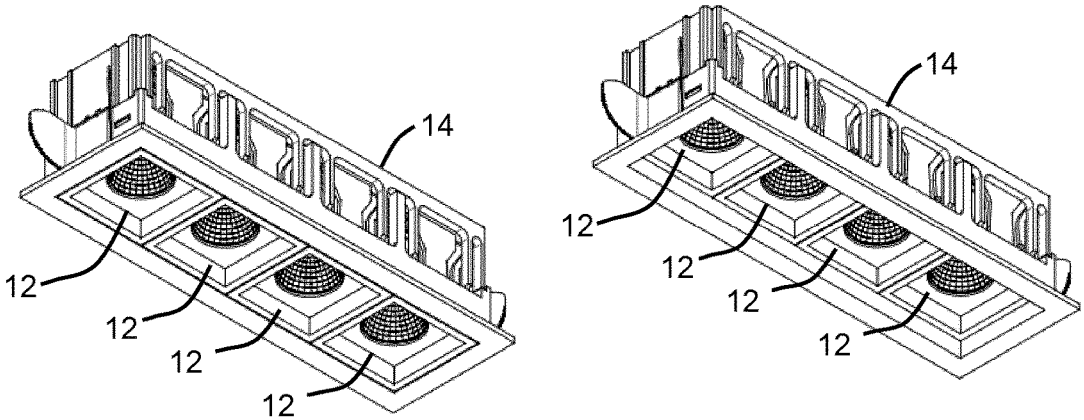
FIG. 13 shows an example of a luminaire in which the outer housing receives four inner housings.

FIG. 13 shows one example based on FIGS. 1 and 2, but with the outer housing 14 receiving four inner housings 12.

Thus, it can be seen that the system is modular. Different inner housings (featuring different front end designs, optical elements, adjustable or fixed) may be combined with different outer housings (with a rim or without, all capable of hosting 1, 2, 3 or more inner housings). Thus, different inner housing designs may be used for different optical effects, again for a modular and flexible overall system.

The inner housings for example have the guide slots only on two opposite faces, so that inner housings may be butted side to side (in a single line) but still with all of the guide slots exposed. Thus, in a rectangular arrangement, the guide slots and guide fingers are along the long edges only.

Each inner housing may be independently slidable, but there could also be a rectangular inner housing for example for a pair of light engines which can only be adjusted simultaneously. Various combinations of options in this respect are possible.

The guide slots and the guide fingers may be formed by machining or molding of the inner and outer housings. The parts may be made of any suitable material. This suitability may be reliant on electrical considerations, aesthetic considerations, cost considerations or any other selection factor. They may be, for example, made of plastic, metal or any combination of suitable materials.

The installation of the luminaire involves clamping the outer housing to a sheet or concrete article with the outer housing extending through an opening in the sheet or concrete article. This can be performed as explained above.

The inner housing which carries the lighting is inserted into the outer housing.

For the first position, the inner housing is slid within the outer housing to the first latched position.

For the second position, the inner housing is slid from the first latched position to the second latched position, in which the second latched position has the inner housing recessed within the outer housing.

To remove the inner housing from the outer housing (e.g. for light engine replacement, servicing, or for a change of accessories) the inner housing is slid from the second latched position to the release position such that it then drops partially out and can then be pulled out completely easily, with no tools.

The examples above are all based on square or rectangular openings in the ceiling. However, the same concept may be applied to a circular luminaire, or indeed any other shape. A shape feature may be needed to ensure the inner housing is mounted in the outer housing at the correct angular orientation to provide alignment of the guide fingers and slots.

The solution is easy to install for a lighting installer and also customer-friendly in that light engine replacement and lighting adjustment is easy for the user. The different lighting positions can be made without reinstalling the luminaire.

The guide finger and slot design is only one way to achieve the desired push operation function. Essentially, there is a cycle between latch positions (two or more) and a release position, based on simply pushing the inner housing inwardly. Other cam or channel arrangements may be used to implement the same function.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. A luminaire comprising:

an outer housing;

a clamping arrangement for clamping the outer housing to a sheet or concrete article with the outer housing extending through an opening in the sheet or concrete article;

an inner housing, which is slidable within the outer housing; and a lighting unit carried by the inner housing, wherein the inner housing is insertable into and completely removable from the outer housing, wherein the inner housing is adapted to be:

slidable within the outer housing to a first latched position after insertion;

slidable from the first latched position to a second latched position, in which the second latched position has the inner housing recessed within the outer housing, and completely removable from the outer housing by sliding the inner housing from the second latched position to a release position in which the inner housing is further recessed within the outer housing, wherein one of the inner housing and the outer housing comprises sprung guide fingers and the other of the inner housing and the outer housing comprises guide slots forming four guide finger and guide slot pairs, and wherein, for each guide finger and guide slot pair, the guide slot comprises a first catch portion for the guide finger for setting the first latched position and a second catch portion for the guide finger for setting the second latched position.

2. The luminaire as claimed in claim 1, wherein the luminaire is a recessed luminaire, a surface mounted ceiling luminaire, or a wall luminaire.

3. The luminaire as claimed in claim 1, wherein in the first latched position, an outer face of the inner housing can be flush with or protruding from an outer face of the outer housing.

4. The luminaire as claimed in claim 1, wherein the sliding to the first latched position, the sliding to the second latched position and the sliding to the release position are all adapted to be performed by pushing the inner housing.

5. The luminaire as claimed in claim 1, adapted to provide an audible sound associated with the first and second latched positions.

6. The luminaire as claimed in claim 1, wherein the guide slot comprises an end portion for setting the released position.

7. The luminaire as claimed in claim 6, wherein the guide slot comprises a U-shaped channel wherein one arm defines the first and second latched position and the guide finger is insertable into the one arm, the end forms the end portion, and other arm forms a removal path.

8. The luminaire as claimed in claim 7, wherein the removal path comprises a third catch portion for preventing the inner housing falling out of the outer housing.

9. The luminaire as claimed in claim 1, wherein the lighting unit comprises a light engine which comprises one or more light sources, one or more optical elements and a heat sink.

10. The luminaire as claimed in claim 1, comprising a plurality of inner housings slidable within a shared outer housing.

11. The luminaire as claimed in claim 1, wherein the inner housing is completely removable from the outer housing to thereby enable replacement of the lighting unit without requiring tools.

12. The luminaire as claimed in claim 1, wherein, for each guide finger and guide slot pair, the guide slot further comprises the release position whereby the guide finger is permitted to move freely along a removal path thereby enabling removal of the inner housing from the outer housing.

13. The luminaire as claimed in claim 12, wherein the inner housing can be removed by hand without activating any further release mechanisms.

* * * * *